US011229269B2

(12) United States Patent
Tucker

(10) Patent No.: US 11,229,269 B2
(45) Date of Patent: Jan. 25, 2022

(54) HAIR WEAVE DRYER

(71) Applicant: Erica Rochelle Tucker, Oakland, TN (US)

(72) Inventor: Erica Rochelle Tucker, Oakland, TN (US)

(73) Assignee: Erica Rochelle Tucker, Oakland, TN (US)

( * ) Notice: Subject to any disclaimer, the term of this patent is extended or adjusted under 35 U.S.C. 154(b) by 64 days.

(21) Appl. No.: 16/587,850

(22) Filed: Sep. 30, 2019

(65) Prior Publication Data

US 2020/0107623 A1 Apr. 9, 2020

Related U.S. Application Data

(60) Provisional application No. 62/742,268, filed on Oct. 5, 2018.

(51) Int. Cl.
*A45D 20/12* (2006.01)
*A41G 5/00* (2006.01)
*A45D 20/14* (2006.01)

(52) U.S. Cl.
CPC ..... *A45D 20/12* (2013.01); *A41G 5/004* (2013.01); *A45D 20/14* (2013.01)

(58) Field of Classification Search
CPC ..... A45D 20/00; A45D 20/12; A45D 20/14; A41G 5/04; A41G 5/00
USPC ..... 34/523, 97–100
See application file for complete search history.

(56) References Cited

U.S. PATENT DOCUMENTS 3,267,587 A * 8/1966 Niemiec ..... A45D 20/44 34/99
3,727,322 A * 4/1973 Walter ..... A45D 20/44 34/99
3,777,406 A * 12/1973 Nopanen ..... A45D 20/44 34/99
5,313,716 A * 5/1994 Wolfe ..... A45D 20/16 34/90
5,606,640 A * 2/1997 Murphy ..... A47K 10/06 219/521
5,752,326 A * 5/1998 Trim ..... A47K 10/48 34/219
6,067,725 A * 5/2000 Moser ..... A47K 10/48 34/223
6,212,790 B1 * 4/2001 Stetson ..... A45D 20/12 34/103

(Continued)

*Primary Examiner* — Stephen M Gravini

(57) ABSTRACT

A portable hair weave drying device utilizing an external heat or vacuum source is provided. Such a device includes three basic components that are configured to provide an enclosure and internal stand for hair weave placement during such a drying operation. A base for placement of such an internal stand and an ingress port is provided as well, with the port disposed at a bottom location of the overall device for insertion of a heat source (hair dryer nozzle, for instance) or vacuum source (a wet/dry vac nozzle, again, for instance) with an adapter to ensure a snug fit therein. A dome is further provided to place over and around the internal stand and contacted with the base to fully enclose the internal stand (and thus hair weave placed thereon during utilization) and having at least one controlled vent to allow for moisture and hot air to exit during operation.

2 Claims, 4 Drawing Sheets

(56) References Cited

U.S. PATENT DOCUMENTS

| | | | | |
|---|---|---|---|---|
| 6,266,893 | B1 * | 7/2001 | Standley | A45D 20/08 34/239 |
| 8,407,913 | B2 * | 4/2013 | Langley | A45D 19/16 34/95 |
| 8,713,814 | B2 * | 5/2014 | Martin | F26B 21/004 34/90 |
| 9,237,789 | B2 * | 1/2016 | Prehodka | A45D 20/12 |
| 9,826,812 | B2 * | 11/2017 | Sterling | A45D 20/08 |
| 9,901,223 | B2 * | 2/2018 | Ricketts | A47K 3/282 |
| 9,951,463 | B2 * | 4/2018 | McLoughlin | A45C 3/004 |
| 10,041,205 | B2 * | 8/2018 | McLoughlin | D06F 59/02 |
| 2008/0257374 | A1 * | 10/2008 | Lee | A45D 44/00 132/271 |
| 2012/0324755 | A1 * | 12/2012 | Zhao | A45D 20/12 34/427 |
| 2014/0068959 | A1 * | 3/2014 | Kim | A45D 20/08 34/97 |
| 2014/0202020 | A1 * | 7/2014 | Torres | A45D 20/124 34/97 |
| 2019/0166969 | A1 * | 6/2019 | Brownlee | F26B 25/066 |
| 2020/0107623 | A1 * | 4/2020 | Tucker | A41G 5/004 |

* cited by examiner

HAIR WEAVE DRYER

FIELD OF THE INVENTION

The disclosure relates to a portable hair weave drying device utilizing an external heat or vacuum source. Such a device includes three basic components that are configured to provide an enclosure and internal stand for hair weave placement during such a drying operation. Additionally, a base for placement of such an internal stand and an ingress port is provided as well, with the port disposed at a bottom location of the overall device for insertion of a heat source (hair dryer nozzle, for instance) or vacuum source (a wet/dry vac nozzle, again, for instance) with an adapter to ensure a snug fit therein. A dome is further provided to place over and around the internal stand and contacted with the base to fully enclose the internal stand (and thus, hair weave placed thereon during utilization) and having at least one controlled vent to allow for moisture and hot air to exit during operation. The entire device is non-collapsible and withstands the heat from the heating source as well as the pressure generated from the vacuum source.

BACKGROUND OF THE INVENTION

Hair weaves and other types of wigs, whether made from authentic human hair, artificial hair, or other sources (animal hair, for instance) have been utilized for many years as a way for individuals to provide differing presentations of one's own coif. Whether for aesthetic, beauty, or health reasons, such weaves have provided invaluable benefits for countless persons.

Such weave articles typically require significant upkeep to retain desired aesthetic qualities if not to provide safe and healthy characteristics for the wearer/user. Thus, as one example, the ability to clean, whether through shampoo or other like and potentially standard washing method, has been undertaken to, again, retain certain qualities and beneficial conditions of the weave structure, whether in terms of appearance, safe handling and wearing, or both. Such cleaning activities require a certain degree of involvement by the wearer/user to ensure proper desired levels are attained and, as with natural hair grown on a person's scalp, typically requires drying to ensure both a controlled appearance and styling capacity, again to allow for proper aesthetic qualities, ultimately, for and by the wearer/user. Such drying, however, has proven to be somewhat difficult and time-consuming in the past, whether in terms of placing such a weave article on the wearer/user's head and drying with a nozzle dryer by hand, placing the same on a mannequin-like stand for external drying, or even placing within a heated container to cause a drying effect therein. Additionally, there are certain individual hair extension (weft) drying devices that require individual portions to be held by individual clips within a closed drying device. In any of these alternatives, however, there is lacking a device that allows for a thorough and circulating drying current to apply thoroughly and continuously within, through, and over the subject weave article for a hands-free drying result. Additionally, such past devices, particularly those including enclosed compartments with externally introduced drying streams (such as through a hair dryer) lack circulating effects and aids. One, in particular, is limited to a collapsible plastic container that is squared in shape (for ease in folding for stowage after utilization) that, again, lacks a circulating capability for improved drying results.

In effect, then, there is lacking a hair weave (such as a full wig or multiple connected weave composite with extensions, etc., as opposed to single weft portions) drying device that imparts a full hands-free drying air stream continuously circulating to allow for quick and thorough moisture removal. Furthermore, there is lacking any such device in a non-collapsible structure (such as with a resilient material that remains dimensionally stable during use, whether, for instance, utilized with a hair drying air stream or a vacuum device to remove moisture in such an alternative fashion). As such, the weave drying industry is lacking such a versatile and effective device as of today.

ADVANTAGES AND BRIEF SUMMARY OF THE INVENTION

A distinct advantage of the versatile weave drying apparatus/device now disclosed is the provision of a parabolic dome with a drying stream ingress port within a base to allow for heated air to circulate upward and through the entirety of the device up to a vent at the apex thereof the dome. Another advantage includes the ability to provide an adapter at the ingress port to allow for different sizes of hair dryer nozzles to interface properly and appropriately for the necessary heated air stream to enter and circulate as noted above. Another advantage thereof is the resilient quality of the dome component, as well as the base, and an internal weave retention rack, to withstand heat from such a hair dryer air stream source to permit thorough drying of the subject weave article as well as to withstand the introduction, if desired, of a vacuum source through the same ingress port, thereby retaining shape and stability during a vacuum operation for moisture removal (and with the vent portions closed). Yet another advantage is the ability of the rack to provide a suitable retention stand within the internal portion of the dome/base structure as well as to allow for such heated air to stream through the hair weave article during operation, as well as to retain, suitably and resolutely, such a weave article if and when a vacuum operation is undertaken. Still another advantage of the overall device and system is the inclusion of an adapter to allow for hair dryer nozzle introduction as well as vacuum (such as a wet/dry vac nozzle component, as one example) hose introduction for versatile utilization of both types of alternative moisture removal devices.

Accordingly, the inventive hair weave moisture removal device comprises i) a flat bottomed base component having an external top annular ridge extending upward therefrom such that the ridge is present as a wall extending from the base with an external vertical component, an internal vertical component, and a horizontal top edge, the base component further including an ingress port having an external opening and an internal opening present within a portion of the annular ridge, ii) a removable dome component having closable vents at the highest central part thereof and a parabolic shape to curve inward from an annular open bottom portion thereof, wherein the annular open bottom portion is aligned to fit within the annular ridge of base component such that the dome bottom portion aligns with the flat base portion within the confines of the annular ridge, and iii) an internal hair weave retention rack component configured to fit within the dome component and the base component when the dome component is placed and aligned on the base component, wherein the retention rack component is provided as an open structure to allow for heat to circulate therethrough and further includes a retention component to retain a hair weave article. Also included within this disclosure is the provision of an adapter device for introduction within at least the ingress opening leading from the external portion of the base component through to the internal portion of the dome component in order to allow for a hair dryer device nozzle and/or a vacuum hose nozzle to be introduced snugly therein during utilization and operation for moisture removal from a subject retained hair weave article. The method of moisture removal of a retained subject hair weave article utilizing the device either with a hair dryer heat source circulating heated air through the parabolic dome component and around and within the retained hair weave article or through vacuum generation and pressure generation and moisture removal, is also encompassed within this disclosure.

Such a device is portable and provided in at least three distinct pieces that are configured to be placed together to provide an enclosure with an ingress port leading from the outside of the base component to the inside of the device to permit an external heat or vacuum source to actively remove moisture from a subject hair weave article during operation. The ability to simply place a base component on a flat surface (with the flat bottom surface of the base component allowing for such an activity), introduce the retention rack with the subject hair weave article thereon, and then placing and aligning the dome component over the retention rack and weave article and within the confines of the base component annular ridge surface, thus allows for the device to then be operated through introduction of a heated air stream or vacuum pressure to remove moisture from the subject hair weave article. Such a hands-off approach thus allows a user to simply introduce the hair dryer air stream source through the ingress port(s) and leave the same in place for a desired amount of time until the circulating hot air streams evaporate the moisture and blow moisture, as well, from the hair weave article surfaces. The materials of the base component and dome component are accorded in such a manner as to easily withstand, without any loss in dimensional stability or other type of structural compromise due to the heated air streams themselves during such operation, thus allowing, again, for the hands-free capability for the user without fear of melting, distorting, or other type of moisture removal device failure in relation to such temperatures and continuous (until shut off, of course) hot air streams. Additionally, the versatile nature of the device is further enhanced by the structural strength and resiliency of the overall material capability of the components, particularly as it concerns the alternative potential for utilizing a vacuum device instead of a hair dryer to accord moisture removal capabilities. Certainly, there is no requirement that a vacuum device be utilized instead of a typical hair dryer, but the ability of the device to accord such an alternative, particularly, again, due to the overall resiliency of the structural components thereof, allows for a user to have an alternative capability in case one's hair dryer has malfunctioned, as one example, and a vacuum device is at the ready instead.

As for the component parts, the parabolic dome component is provided in a fashion that allows for a heated air stream to be introduced through the base component ingress port as it is placed on the annular ridge surface thereof with a cavity at the bottom leading to an upper surface within which vents are located. The parabolic shape thereof allows the introduced air to circulate annularly around the internal portion thereof and upward to thoroughly provide heat to the subject hair weave article during a drying operation. The parabolic structure thus allows for concentrated heating to occur as the air stream circulates upwardly and around and through the hair weave article, as well, thus according a continuous and more efficient drying manner overall. The dome itself includes, as noted above, vents to allow for both the heated air as it circulates to exit the dome as well as moisture to evaporate and leave the dome, as well, again, effectively drying the hair weave article. Such vents are preferably disposed at the highest point of the dome, thus providing a "flat" top at such a location with such vents incorporated therein. Due to the parabolic nature of the dome component, whereby a wider bottom edge is provided and, as it follows a parabolic curve throughout the entirety of the structure, the dome structure gets smaller in diameter as it gets taller, thus providing the circulating and concentrating of heated air streams introduced therein. As it is, then, instead of coming to a definite point at the dome top, or, more specifically, having a top curved lock, the dome component may, again, be leveled into a flat top edge to accommodate the vents therein. The overall dimensions of the dome component is not particularly significant except to permit the retention rack to easily be disposed therein to hold the hair weave article and permit the air stream circulation throughout the internal portion thereof. If the hair weave article were to fill the completely or mostly internal space of the dome component, drying would be delayed since hot air stream circulation would be limited significantly. Thus, the dome component should be configured of a size that allows for the majority of space, roughly, therein (volume wise, that is) to be open to allow for such circulation around and within the subject hair weave article. A base diameter of from 12 to 24 inches and a top edge diameter (flat for vent introduction, as noted above) of rough 2 to 6 inches may be potentially preferred with the height of the dome component from 18 to 30 inches, again roughly, for such a purpose, as well. The parabolic structure can thus be within the confines are such dimensions to allow for such overall measurements. The vents may be provided as one to as many as six (and potentially more) of differing dimensions themselves, as long as some degree of water vapor (evaporated moisture) is accorded through the presence of such vents within the top edge of the dome component. To allow for a vacuum alternative, such a vent may be provided as closable through any typical means, including screw-type vents, movable opening vents, rotating slat vents, and the like.

The retention rack component for the hair weave article inside the dome component (and the base component, when both are placed together) is provided in a manner that, as alluded to above for the dome component, allows for full and effective hot air streams to circulate around and through the subject hair weave article during operation. In this way, the rack is utilized to effectively spread or otherwise disentangle the subject hair weave article over, at least, and possibly through the rack (with the ability, if desired, to clip or otherwise attach at least certain discrete portions of the hair weave article, as well) for such air circulation purposes. One potentially preferred structure is an A-frame like configuration having two opposing A structure with a connecting rod at the top of each A and two other rods connecting at the mid-point of each A. The legs of each A may then be placed on the top surface of the base component within the confines of the dome component (when placed and aligned together) with the A structures emulating the curvature, or at least the narrowing, of the parabolic dome shape. Again, clips or other attachment devices may be utilized to allow for the secure retention of the hair weave article to the rack during moisture removal operations, as well. Such is particularly important as it concerns the alternative vacuum procedure, specifically because the vacuum generation creates the propensity for the hair weave article to seek movement itself out the egress port within the dome component and base component and into the vacuum nozzle, etc. Clipping, etc., thus helps prevent such article movement and allows for the vacuum to remove, primarily, moisture from the surface thereof, not the actual hair weave article itself. Such an alternative vacuum capability provides a versatility of hair weave article moisture removal that has heretofore been unexplored. The vacuum moisture removal alternative is provided through the ability to not only close the dome component vents, but the resiliency and dimensional stability of the entirety of the device itself when subject to either of hot air streams from an externally supplied hair dryer through the ingress port(s) or vacuum pressure from an externally supplied vacuum device (such as, without limitation, a wet/dry vac machine with a hose and nozzle). The wet vac capability allows for drawing in moisture without harming the vacuum machinery, of course, and the dimensional stability of the base component, dome component, and retention rack all allow for such vacuum pressures to be applied without harming or otherwise compromising the actual device structure and thus permitting its utilization in the future whether in terms of hot air stream drying or further vacuum drying operations. Thus, the components parts may be materials of certain polymers, woods, even metals, and even combinations thereof, if desired. Hard plastics, such as polyacrylates, high density polyethylene, polycarbonate, ABS, polystyrenes, and the like, may be utilized. A base made from aluminum, a dome from hard plastic, and a rack from a different types of hard plastic may be utilized, as well. Again, such materials simply must withstand both hot air stream applications and vacuum pressures (as are typical of wet/dry vacs and standard vacuum cleaners, at least) to accord the needed dimensional stability for complete and continued operation thereof as needed.

The base component is structured with a flat bottom surface in order to allow for placement of the overall device on a safe and level location. As noted above, the material for such a component must withstand heat and pressure characteristics, and must also ensure that any typical hot air streams do not transfer through the base to the underlying surface in such a manner as to harm, distort, mar, or otherwise compromise the same. The base component is provided, again, as alluded to previously, with an annular ridge (wall, for instance) extending from the bottom thereof upward. This annular wall (ridge) provides an aligned surface for the dome component to be placed in a secure fashion to create the enclosure for moisture removal operations thereof. Additionally, however, the annular ridge will include a further horizontal extension in one portion thereof for placement of the ingress port leading through the annular ridge therefrom into the internal portion of the device (upon placement, for instance, of the dome component). Such an ingress port is provided of a size that allows for introduction of either a hair dryer nozzle or vacuum hose nozzle, as noted above, or an adapter to allow for smaller or larger nozzles to be introduced and securely and reliably connect and provide either a hot air stream (dryer) or vacuum pressure while the user leaves the device to operate without user involvement. Such an adapter may be provided in any number of different structural shapes and sizes and may align with a flattened nozzle shape, a circular (cylindrical) nozzle shape, or other type as needed. Multiple adapters may be provided in association with such a device, as well, if necessary. The base component further may be provided with a round bottom surface shape (to match that of the annular ridge, for example), or may be of a different shape than the annular ridge itself, if desired (squared, for instance, and the like, whatever geometric shape possible).

These and other aspects of the disclosed subject matter, as well as additional novel features will be apparent from the description provided herein. The intent of this summary is not to be a comprehensive description of the subject matter, but rather to provide a short overview of some of the subject matter's functionality. Other systems, methods, features, and advantages here provided will become apparent to one with skill in the art upon examination of the accompanying FIGURES and detailed description. It is intended that all such additional systems, methods, features, and advantages that are included within this description, be within the scope of any claims filed now and/or later.

BRIEF DESCRIPTION OF THE DRAWINGS

The novel features believed characteristic of the disclosed subject matter will be set forth in any claims that are filed now and/or later. The disclosed subject matter itself, however, as well as a preferred mode of use, further objectives, and advantages thereof, will best be understood by reference to the following detailed description of an illustrative embodiment when read in conjunction with the accompanying drawings, wherein:

DETAILED DESCRIPTION OF ILLUSTRATIVE EMBODIMENTS

Reference now should be made to the drawings, presented as non-limiting possible embodiments in accordance with the descriptions provided above. The ordinarily skilled artisan would fully understand the breadth and scope intended herein in relation to the following potentially preferred types.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing embodiments only and is not intended to be limiting. As used herein, the singular forms "a", "an", and "the" are intended to include the plural forms as well unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
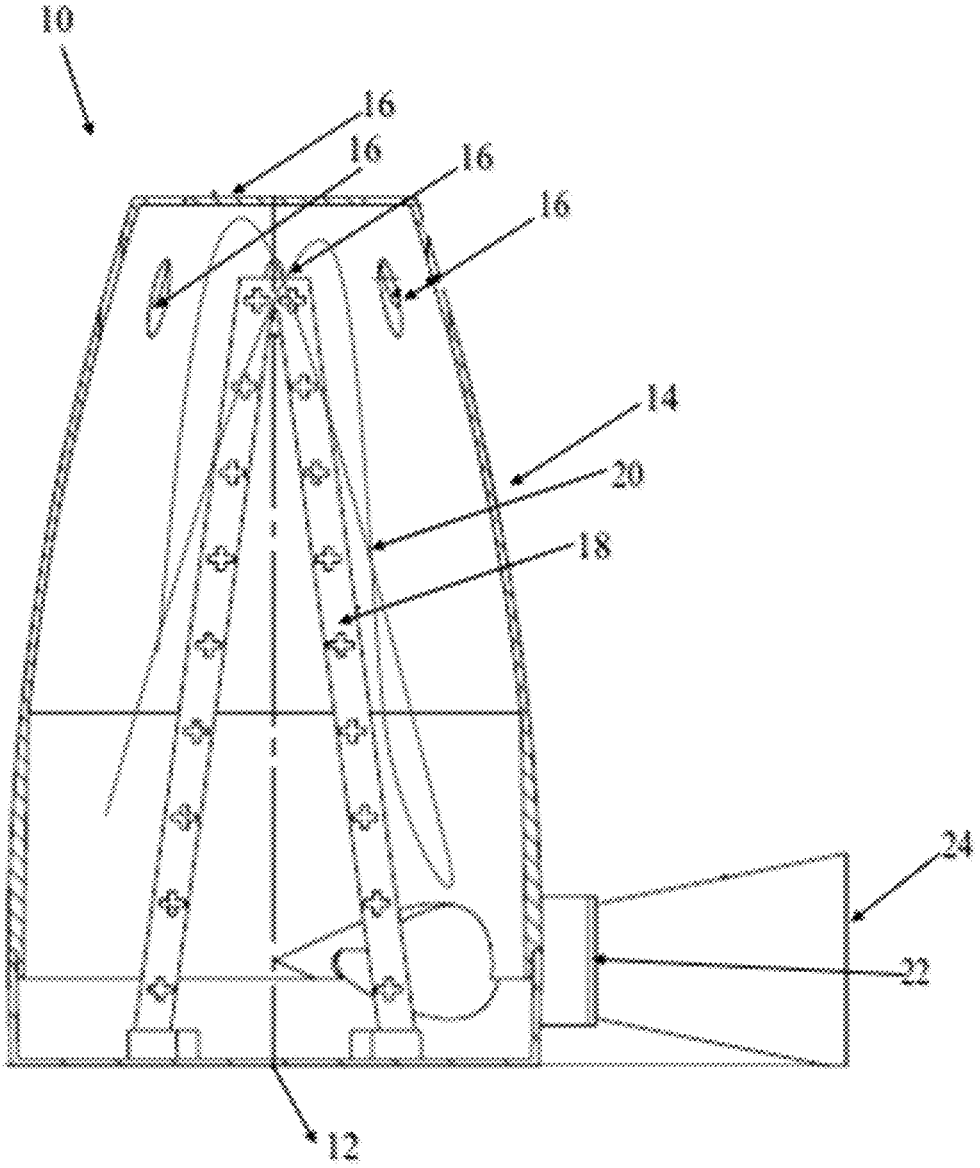
FIG. 1 depicts a cross-sectional view of one possible embodiment of a hair weave article moisture removal device described herein.

FIG. 1 depicts a cross-sectional view of the portable moisture removal device 10 including the base component 12, the dome component 14, with vents 16, and the retention rack 18, with the hair weave article 20 present thereon. The base component 12 includes the ingress port 22 with such leading to a port 24 within the dome component 14 in order to allow for an external device (such as a hair dryer, 60 of FIG. 3) to be introduced to create hot air streams for circulation through the device 10 during operation. The retention rack 18 includes legs (attaches to locking lots 65 of FIG. 2) 26 on the top surface 28 of the base component 12 and rods 30 for providing surfaces for the hair weave article 20 to be placed during utilization. Additionally, clips 32 are provided as options for attaching portions of the hair weave article 20 to the rack 18, as well or (65 of FIG. 2) angle rack to wrap hair weave.

Furthermore, an adapter 34 is provided to allow for different size nozzles to associate with the ingress port 22 of the base component 12. Such an adapter 34 includes, potentially, an internal gasket 36 to provide a sealed attachment to the nozzle; additionally, such an adapter 34 potentially includes an external gasket 38 to provide a sealed attachment to the ingress port 22, as well. Additionally, then, the ingress port 22, may itself include a gasket 40 for such a purpose for sealing contact with either a nozzle or the adapter 34.

Figure 2:
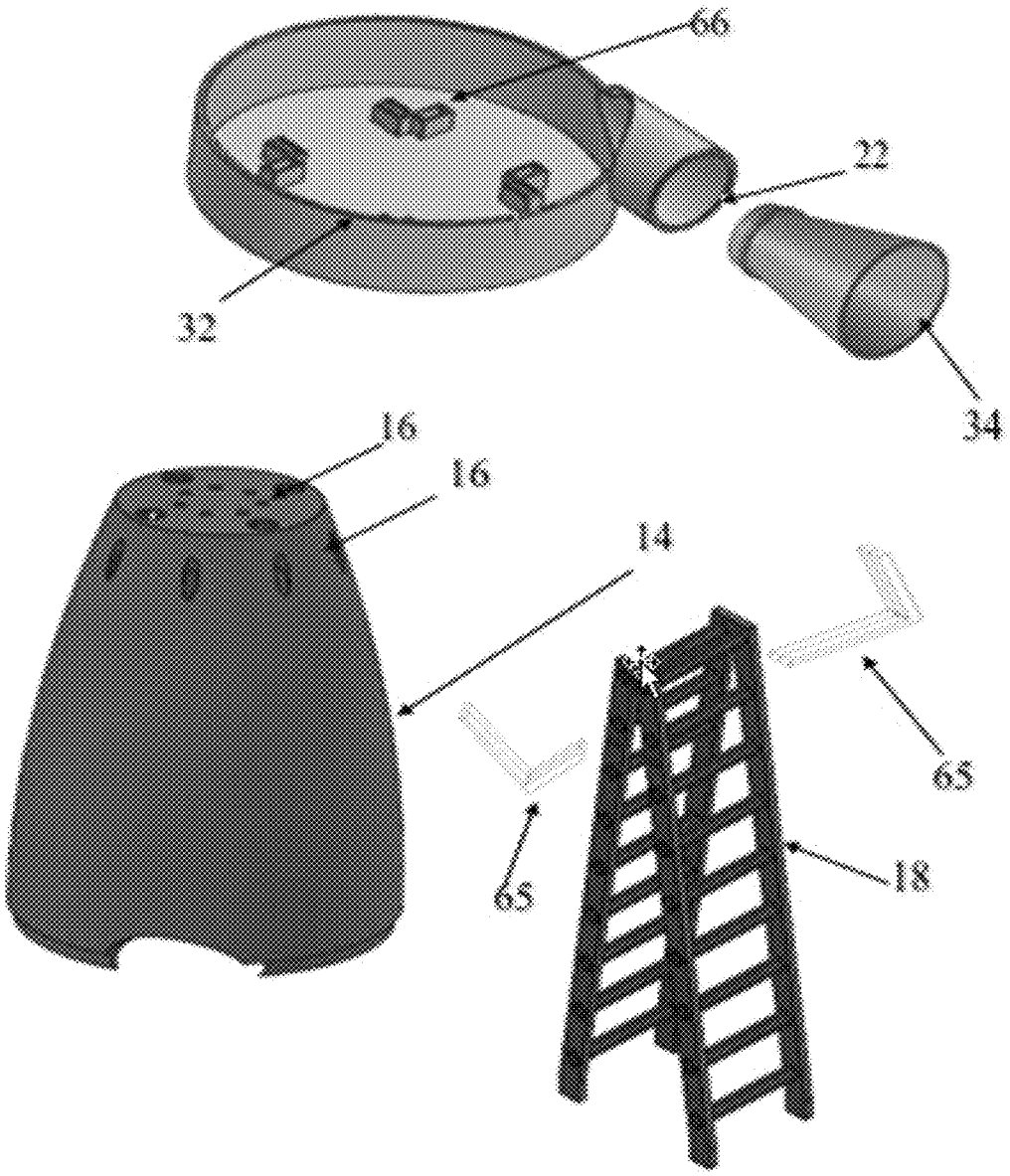
FIG. 2 depicts the same device as in FIG. 1 in exploded fashion showing the individual components thereof.

FIG. 2 thus shows the different parts of the device 10 separated to show the portability thereof. The dome component 14 includes the aforementioned vents 16 that are able to be opened and closed on demand (depending on the type of moisture removal external source is used, as noted above). The parabolic shape hereof allows for the more effective and efficient hot air stream circulation, as well. The top edge 42 thereof includes the vents 16 and the bottom edge 43 aligns with the annular ridge 48 of the base component 12 allowing for air flow or vacuum pressure to enter or leave through the ingress port 22 of the base component 12. The rack 18 is provided here as an A-frame structure with two A sides 44, and connecting rods 46 and legs 26. The base component 12 thus has an annular ridge 48 (for aligned placement of the parabolic dome component 14), a bottom flat surface 50, the ingress port 22 with gasket 40, and a top flat internal surface 52 on which the rack 18 is placed during operation. The adapter 34 is further shown (more than one may be provided, as noted above, for different nozzle structures as needed) with an opening 54, an internal gasket 36, an external gasket 38, a middle channel 56, and a further opening 58 for egress to the base component 12 ingress port 22. The hair weave article 20 shown separated from the rack 18, as well.

Figure 3:
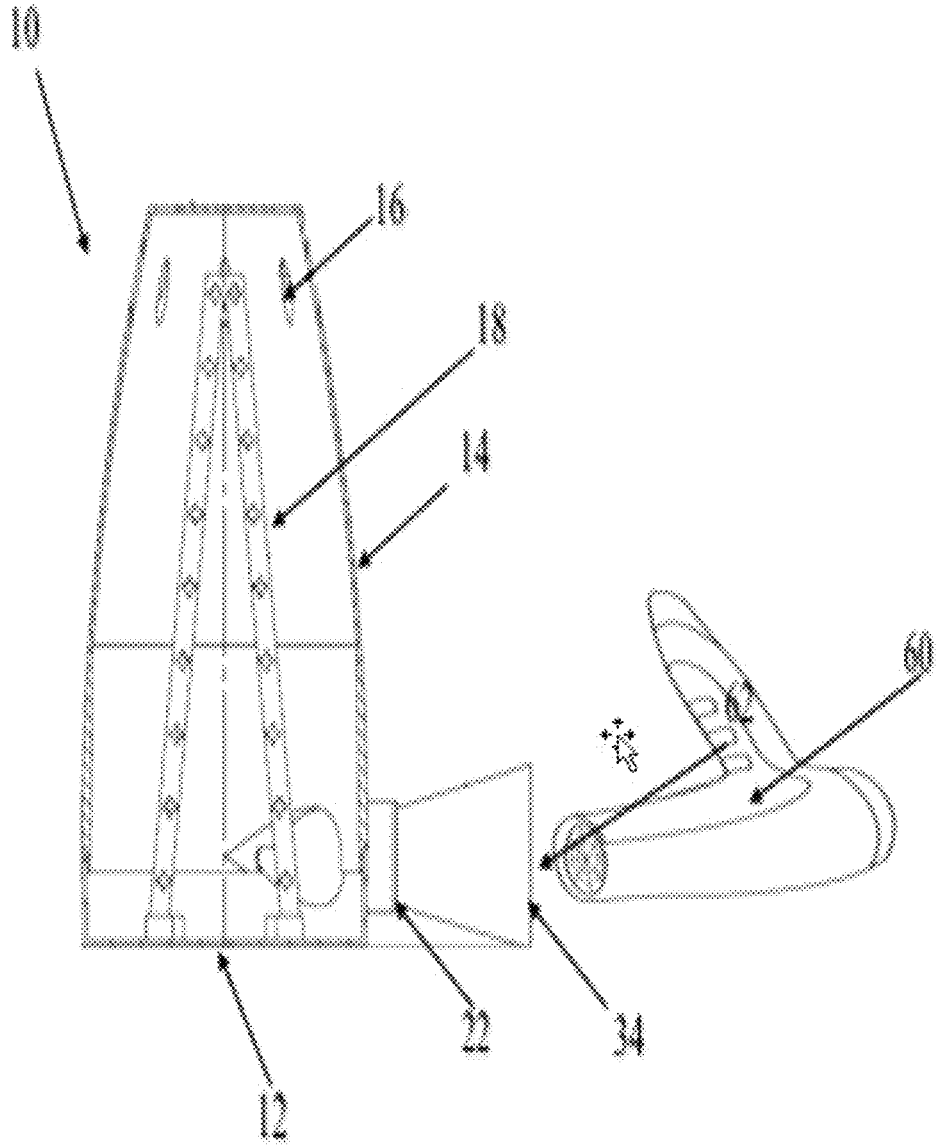
FIG. 3 depicts the same device as in FIG. 1 with a hair dryer device utilized for moisture removal.

In operation with a hair dryer 60, FIG. 3 shows the insertion of the hair dryer nozzle 62 within the adapter 34 and placement thereof within the ingress port 22 of the base component 12. In this manner, upon activation thereof, the hair dryer 60 introduces hot air streams (not illustrated) within the dome component 14 to effectively circulate such streams around and through the hair weave article 20 to evaporate and blow moisture therefrom to exit the open vents 16. The user may then undertake a different activity while this operation occurs. After a time of from 2 to 10 minutes (preferably about 4-6 minutes), the user may deactivate the hair dryer 60, remove the dryer nozzle 62 and adapter 34 from the ingress port 12 of the base component 12, and then lift the dome component 14 from the base component 12, detach (if clipped or otherwise attached) the hair weave article 20 from the retention rack 18, and enjoy the dried (and cleaned) hair weave article 20, as needed.

Figure 4:
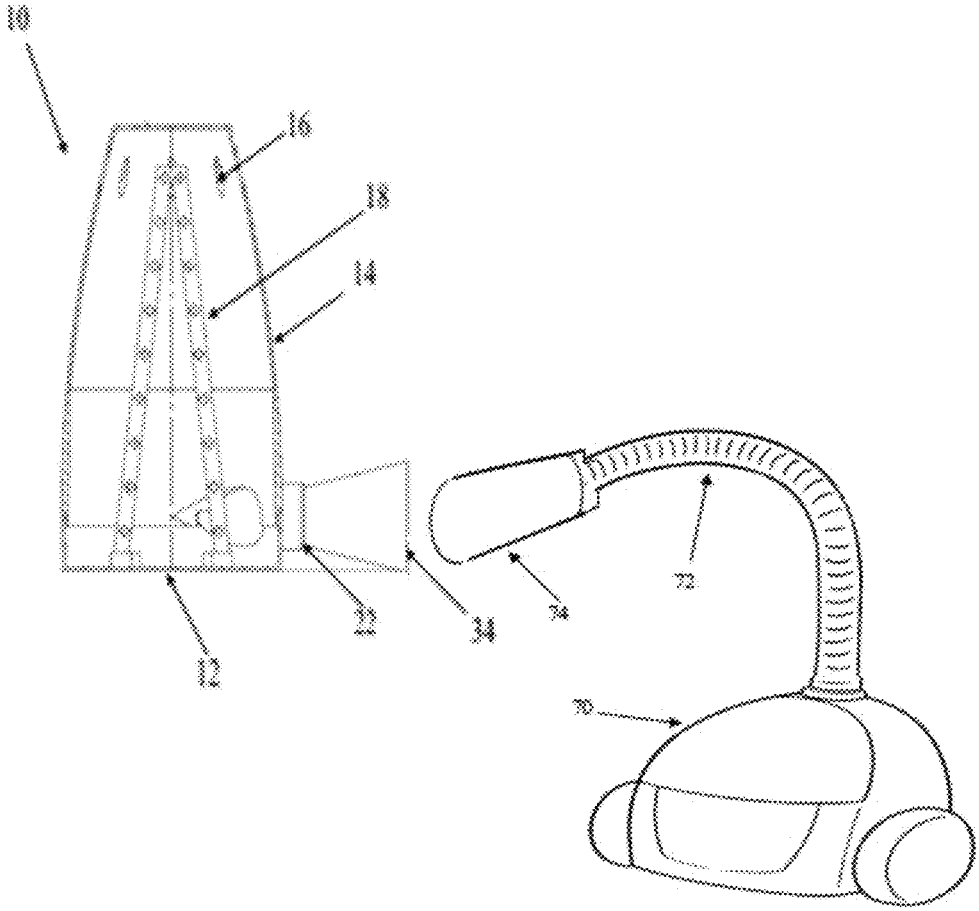
FIG. 4 depicts the same device as in FIG. 1 with a vacuum device utilized for moisture removal.

The alternative moisture removal method of FIG. 4 provides a vacuum device 70 with a hose 72 and nozzle 74 associated with the ingress port 22 of the base component 12. The vents 16 of the dome component 14 are closed. The hair weave article 20 is clipped to the retention rack 18 in different places 76, as well, and then the vacuum device 70 is activated to draw moisture out of the ingress (now egress) port 22 of the base component into the nozzle 74. Within the same basic time frame (2 to 10 minutes, preferably 4 to 6) the user is free to undertake a different activity until drying is completed. The user can then deactivate the vacuum device 70, remove the nozzle 74 from the ingress port 22 of the base component 12, lift the dome component 14 from the base component 12, detach the attached hair weave article 20 from the retention rack 18 and enjoy the dried (and cleaned) hair weave article 20, as desired.

Thus, with this type of device, of which this is merely one possible embodiment, of course, there is provided a totally hands-free hair weave article moisture removal procedure. In addition, the device is completely portable, can be placed anywhere desired with a flat surface, can be utilized with either a hair dryer or vacuum device, and provides complete moisture removal through a continuous and effective (and efficient) circulating air stream or vacuum application.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the description herein cover any and all such applications, modifications, and embodiments within the scope of the present invention.

What is claimed is:

1. An inventive hair weave moisture removal device comprising:

i) a flat-bottomed base component having an external top annular ridge extending upward therefrom such that the ridge is present as a wall extending from a base with an external vertical component, an internal vertical component, and a horizontal top edge, the base component further including an ingress port having an external opening and an internal opening present within a portion of the annular ridge, ii) a removable dome component having closable vents at a highest central part thereof and a parabolic shape to curve inward from an annular open bottom portion thereof, wherein the annular open bottom portion is aligned to fit within and align with the annular ridge of the base component to fit within the confines of the annular ridge, and iii) an internal hair weave retention rack component configured to fit within the dome component and the base component when the dome component is placed within the base component, wherein the retention rack component is provided as an open structure to allow for heat to circulate therethrough and further includes a retention component to retain a hair weave article.

2. The device of claim 1 further comprising an adapter device for introduction within at least the ingress opening leading from an external portion of the base component through to an internal portion of the dome component in order to allow for a hair dryer device nozzle and/or a vacuum hose nozzle to be introduced snugly therein during utilization and operation for moisture removal from a subject retained hair weave article.

* * * * *